United States Patent [19]

Morris, Sr.

[11] 3,973,099

[45] Aug. 3, 1976

[54] PUSH BUTTON SWITCH FOR ELECTRONIC WATCH

[75] Inventor: James Baker Morris, Sr., San Jose, Calif.

[73] Assignee: American Micro-Systems, Inc., Santa Clara, Calif.

[22] Filed: Nov. 11, 1974

[21] Appl. No.: 522,434

[52] U.S. Cl. ..... 200/159 R; 58/85.5; 200/264; 200/302

[51] Int. Cl.[2] ..... H01H 3/12

[58] Field of Search ..... 200/159 R, 159 B, 264, 200/302; 58/85.5

[56] References Cited

UNITED STATES PATENTS

| | | | |
|---|---|---|---|
| 2,714,284 | 8/1955 | Gazda | 58/85.5 |
| 3,089,009 | 5/1963 | Korsgren | 200/302 X |
| 3,767,875 | 10/1973 | Schneikart et al. | 200/52 R |
| 3,782,102 | 1/1974 | Bergey | 58/85.5 |
| 3,789,167 | 1/1974 | Seeger et al. | 200/159 B |

*Primary Examiner*—Robert K. Schaefer
*Assistant Examiner*—M. Ginsburg
*Attorney, Agent, or Firm*—Owen, Wickersham & Erickson

[57] ABSTRACT

A push button switch for setting the time display of electronic timepieces utilizes a conductive elastomeric material such as silver filled silicone rubber as a conductive spring in its moving contact. The elastomer biased contact may be seated in a port in the watch frame and bonded thereto to make the frame waterproof. Momentary electrical contact is secured by pressing the moving contact against a metal contact portion of the printed circuit time keeping substrate within the watch frame. The watch frame is electrically connected to ground in the electronic watch circuit.

10 Claims, 10 Drawing Figures

PUSH BUTTON SWITCH FOR ELECTRONIC WATCH

BACKGROUND OF THE INVENTION

The present invention relates to an electrical push button switch and more particularly it relates to a push button switch for electronic timepieces having a conductive elastomeric spring.

In the development of electronic watches, utilizing semiconductor integrated circuitry and digital readout devices, such as liquid crystal or light emitting diode displays, the need arose for suitable switching devices by which such watches could be adjusted to display the correct hours, minutes, seconds, date, etc. For some electronic watches, particularly those employing light emitting diode display units, a further switching mechanism was required to activate the display unit momentarily each time that a display of the current time is desired.

Typically, electronic watch circuits are contained in a watch case having an air tight cover, and it is not uncommon that such watches be waterproof and even hermetically sealed. In such watches one prior art approach to the switching requirements, as disclosed in the U.S. Pat. to Bergey, No. 3,782,102, was to employ tiny permanent magnets in a push button device contained on the outside of the watch case. These magnets were positioned so that when the push button was depressed the magnetic field of the permanent magnet in the push button passed through the non-magnetic watch case and attracted a magnetic armature within the sealed watch movement, thereby accomplishing switching. The disadvantages of such a complicated switching device became readily apparent. For one thing, a relatively large number of parts were required for proper functioning of the switch. Also, the watch could not be exposed to magnetic fields since the magnetism of the permanent magnet could likely be altered. Also, two springs were required in order for such a magnetic switch to function: an external spring for biasing the push button outwardly from the watch case and an inward spring for biasing the armature in a position normally away from the position it would be in as a result of the magnetic pull of the push button magnet. Finally, such magnetic switch devices were not only expensive and complicated, but they required precise alignment of the magnet and the armature. The limitations and disadvantages of such switch devices are overcome by the present invention.

Other watch case mounted control switches of the prior art utilized metal parts with very close tolerances, and were press fitted into the watch case. These switches normally utilized a minimum of four separate parts, all of which moved upon one another during any switching operation. The relatively large number of parts as well as the requirement for close tolerances in such switches resulted in relatively high costs. This drawback is likewise overcome by the present invention.

It is therefore one object of the present invention to provide a push button switch for electronic watches that is simple to fabricate and use, and which manifests a long life by having fewer moving parts and thus may be manufactured at substantially lower costs than prior art switches.

Another object of the present invention is to provide a push button switch for electronic watches which is waterproof and which affords a switching function without sacrifice of an air tight seal of the interior chamber of an electronic watch.

Yet another object of the present invention is to provide a push button switch for electronic watches having a moving contact biased by a conductive elastomeric material and adapted to contact an internal metallized switch pad on a printed circuit substrate comprising the electronic circuitry of the watch without need of other fixed or moving parts.

BRIEF SUMMARY OF THE INVENTION

The aforesaid objects are accomplished by a push button switch according to the present invention which advantageously utilizes a conductive elastomeric material such as silver filled silicone rubber. The elastomer is supported by the watch case within a port therein at a location adjacent to a rigid switch contact which may be a metallized portion of a printed circuit substrate of the electronic watch movement within the watch case. The elastomeric material extends through the watch case wall to a point adjacent to the fixed contact, but not touching it. In one embodiment, a rigid pin forming a push button is placed axially into the elastomeric material but not all the way therethrough. When the pin is pressed toward the center of the watch case, the elastomeric material is deformed into a contact engagement with the metallic contact of the printed circuit substrate. In another embodiment the elastomer serves to spring load a movable metal pin serving as both push button and movable contact. As the elastomeric material is conductive, an electrical circuit is completed between the watch case and the printed circuit board upon pressing the pin, thereby electrically controlling watch functions such as time set and display of time. When the pin is released, the elastomeric material returns to its original undeformed position and the switch is thereby restored to its normally open position.

Other objects, advantages and features of the invention will become apparent from the following detailed description of embodiments presented in conjunction with the accompanying drawings.

DESCRIPTION OF THE PREFERRED EMBODIMENTS

Figure 1:
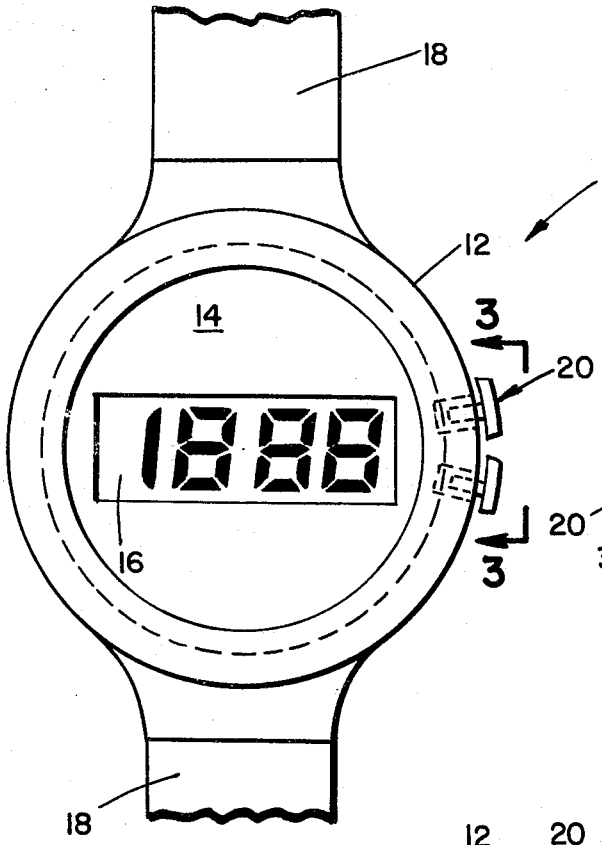
FIG. 1 is an enlarged view in front elevation of an electronic watch having a liquid crystal display and embodying the switch of the present invention with the switch devices shown in hidden view. The watch band is broken away to save space.
Figure 2:
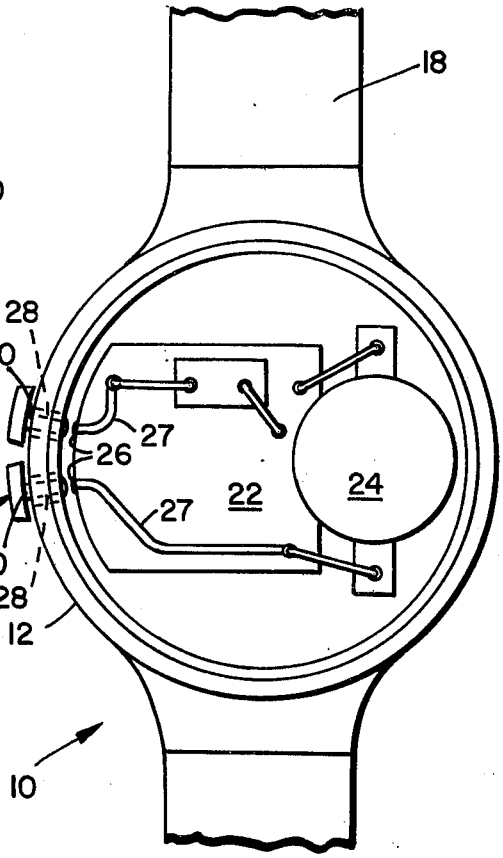
FIG. 2 is a view in rear elevation and partial section of the watch of FIG. 1 with the back watch cover removed to show the switch of the present invention and the printed circuit substrate forming a part thereof.
Figure 3:
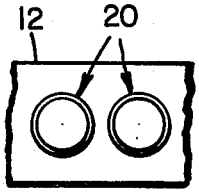
FIG. 3 is a side view in elevation of a portion of the watch of FIG. 1 taken along line 3–3.

WIth reference to the drawings, FIG. 1 shows an electronic watch 10 having a metallic or conductive watch case 12, a face plate 14 and a liquid crystal digital display 16 within the face plate 14. A push button time set switch 20 extends outwardly from the watch case 12. In FIG. 2, the interior of the electronic digital watch is shown in a somewhat diagrammatic format with a printed circuit substrate 22 shown connected to a power cell 24. Adjacent to the push button time set switch 20 are two metallized switch contact pads 26, being a portion of the printed circuit substrate 22. One such pad may be employed to set the hours display and the other pad 26 may be utilized to set the minutes display. Should both push button set switches 20 be depressed thereof so that contact is made with both pads 26, the internal circuitry 27 of the printed circuit substrate 22 may be arranged so that a time holding function obtains.

Figure 4:
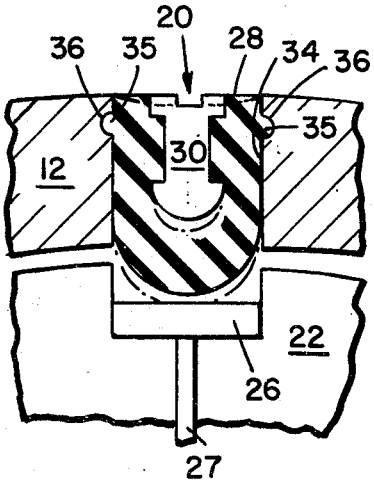
FIG. 4 is an enlarged view in front elevation and section of a push button switch embodying the principles of the present invention shown in its normally open position and shown in its closed position in phantom.

Turning now to the details of one preferred embodiment of the switch, FIG. 4 shows a switch of the present invention mounted within the sidewall of the watch case 12. A conductive elastomeric material, such as silver filled silicone rubber, forms the moving contact member 28 of the switch 20. A non resilient pin 30, typically made of a plastic or metallic material, is embedded axially in the elastomeric member 28. The switch is closed by pressing the pin 30 toward the watch case 12 whereupon the pin deforms and stretches the elastomeric contact member 28 into a contacting engagement with the metallized contact 26 as shown in phantom in FIG. 4. The engagement of the contact surface 32 with the metallized contact 26 continues so long as the pin 30 is pressed. When the pin 30 is released, the elastomeric contact member 28 returns to its original unflexed position and the electrical conduction path between the case 12 and the metallized pad 26 is broken. The elastomeric contact member 28 may be bonded by a conductive adhesive or molded to the sidewall 34 of the watch case 12, or an alternative engagement may be achieved by utilization of an annular ring 35 in the elastomeric contact 28 which mates with a corresponding groove 36 in the sidewall 34 of the case 12. One or more such ring and groove combinations may be employed to achieve the necessary engagement of the elastomer to the sidewall of the case.

Figure 5:
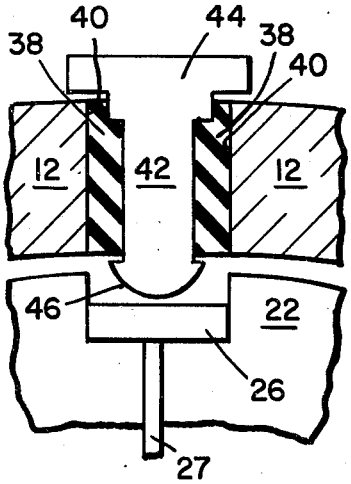
FIG. 5 is an enlarged view in front elevation and section of an alternate embodiment of a switch employing the principles of the present invention and which is shown in open position.

An alternate preferred embodiment of the present invention is shown in FIG. 5. In this preferred embodiment, a conductive elastomeric sleeve 38 is bonded to the sidewall 34 of the case 12 by a suitable conductive adhesive material 40. Seated within this elastomeric sleeve 38 is a conductive metallic pin 42 having a push button end 44 and a contact end 46. When pressure is applied to the push button end 44 the conductive elastomeric sleeve enables the contact end 46 of the pin 42 to engage electrically the metallized contact 26 thereby completing an electrical circuit between the frame 12 and the contact 26. Removal of pressure from the push button end 44 returns the contact end 46 to an unflexed spaced away position relative to the contact 26.

Figure 6:
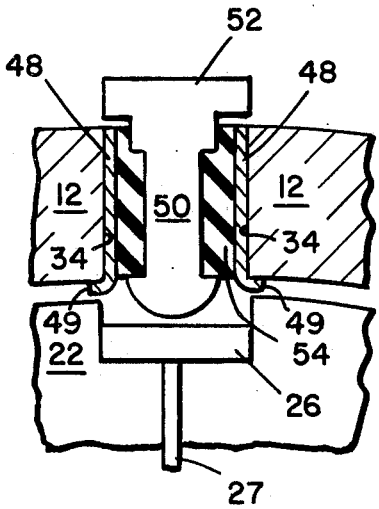
FIG. 6 is an enlarged view in front elevation and section of a still further embodiment of a switch employing the principles of the present invention and which is shown in open position.
Figure 7:
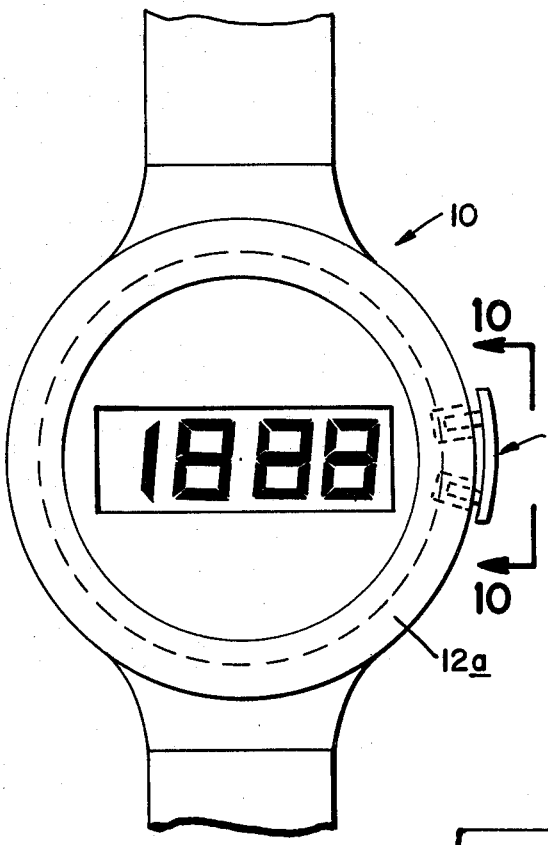
FIG. 7 is an enlarged view in front elevation of the watch of FIG. 1 in which the switches are joined together by a common push button.
Figure 10:
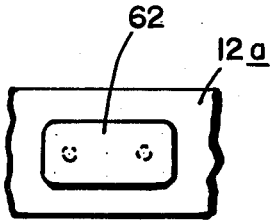
FIG. 10 is a side view in elevation of a portion of the watch of FIG. 7 taken along line 10—10.
Figure 8:
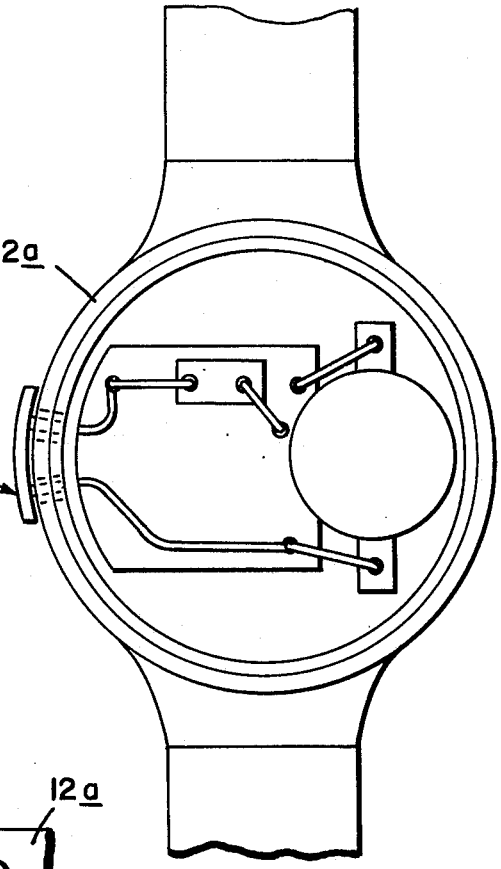
FIG. 8 is a view in rear elevation of the watch of FIG. 7 with the back cover removed.
Figure 9:
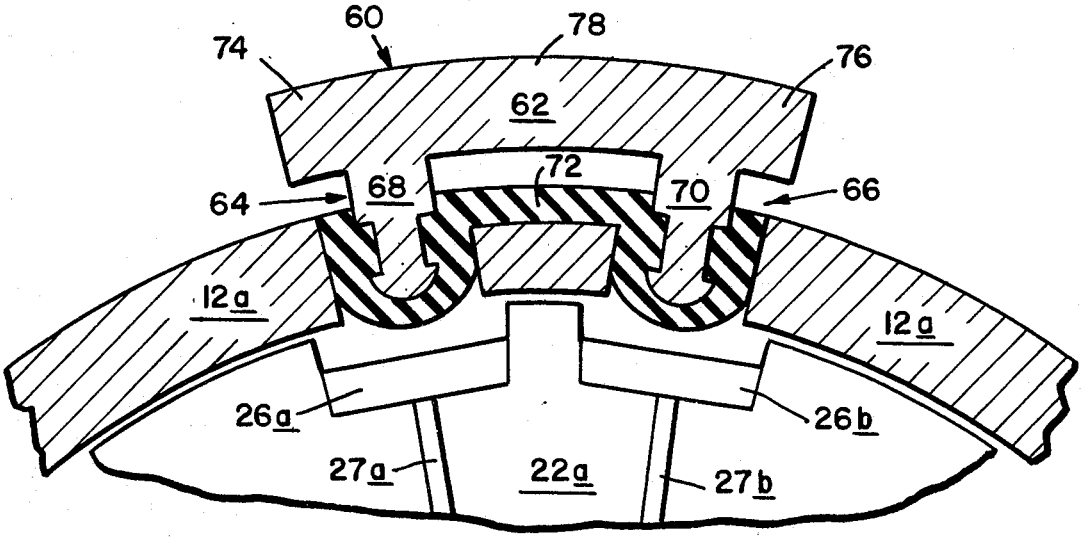
FIG. 9 is an enlarged view in front elevation and section of a portion of the watch of FIG. 7 showing the switches joined by the common push button.

A further alternate embodiment of the invention is shown in FIG. 6. Here, a metal sleeve 48 is press-fitted against the sidewall 34 of the case 12 to achieve a firm and secure mechanical as well as an electrical connection thereto. The sleeve 48 has an inner end portion extending beyond the sidewall 34 within the case 12 and may be swayed into an annular flange 49 as shown in FIG. 6 and then continuously welded to the case 12. A metal pin 50 having a push button outer end 52 is moveably mounted axially within the sleeve by a flexible conductive elastomeric ring 54. Preferably the switch is formed by having the metal pin 50 positioned within the sleeve 48 and then transfer molding the elastomeric ring 54 around the pin 50 and within the sleeve 48 to form a single unitized switch contact member which may be easily and readily mounted within the case 12 to form a waterproof push button switch in combination with the printed circuit contact 26.

A single push button assembly 60 is shown in FIGS. 7–10. It has been found that a single push button bar 62 greatly simplifies time setting operations, and as can be seen in FIGS. 7–10, such a bar may be advantageously used with the switches of the present invention.

In the embodiment shown in FIGS. 7–10 two adjacently spaced apart switches 64 and 66 are joined together by the bar 62. Each switch may comprise the switch of FIG. 4 as described herein with the modification that the pin portions 68 and 70 aand the push button bar 62 may be formed as a single injection molded structure of non resilient material such as plastic. In addition, a molded conductive elastomeric member 72 is mounted in the sidewall of the watch case 12*a* and is adapted to receive the pin portions 68 and 70 which are embedded therein. The switch 64 may be closed by pressing a portion 74 of the bar 62 adjacent to pin 68 thereby causing the elastomeric member 72 to deform and electrically engage a metallized contact 26*a* in the manner previously described. Similarly, the switch 66 may be closed by pressing a portion 76 of the bar 62 adjacent to pin 70 thereby deforming the elastomeric member 72 into electrical contact with a contact 26*b*. Both switches 64, 66 may be closed simultaneously by pressing a middle portion 78 of the bar 62.

Three time set functions in the watch 10 may be achieved by the assembly 60. One switch 64 may be connected to advance the "minutes" display when closed, whereas the other switch 66 may be used to advance the "hours" display. Or, when both switches are depressed, the circuitry of the substrate 22*a* may be configured so that the entire time display is held to enable the actual time to catch up with the indicated display. Of course, when neither switch 64 or 66 is closed, the watch 10 would calculate and display time in its normal operating mode.

Silver filled silicone rubber is the preferred conductive elastomeric material for use in the present invention. Other materials such as polyurethane, plasticized vinyl, neoprene and butyl rubber may also be used. Where a low resistance contact is desired or requisite for proper circuit operation, powdered silver is the preferred filler within the elastomeric material. Where a higher resistance may be employed without degradation of circuit function, carbon may be successfully used as the filler materials. Silver plated copper powder, nickel, tin, zinc, gold and other conductive oxides in combinations of these may be employed.

The metallized switch contact 26 contained within the printed circuit substrate 22 of the electronic digital watch 10 may be a suitable conductor such as an alloy of beryllium and copper.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In an electronic timepiece, an improved push button electrical switch comprising:

a. frame means defining a hole;

b. moveable switch contact means utilizing a body of conductive elastomeric material occupying said hole within said frame means and electrically connected thereto through said elastomeric material and forming a switch contact surface at an interior end thereof, said contact means including a rigid push button means extending into and at least partially surrounded by said conductive elastomeric material and having an exposed portion at its exterior end;

c. a switch contact member within said frame means and adjacently spaced away from said switch contact surface, whereby pressing the push button means deforms said elastomeric material and moves its contact surface into electrical engagement with said contact member thereby closing the switch, and releasing the push button means enables the moveable switch contact means to resume its original position and thereby open the switch.

2. The switch of claim 1 wherein said conductive elastomeric material is bonded to said frame means rendering the switch waterproof.

3. The switch of claim 1 wherein the conductive elastomeric material comprises the combination of silicone rubber and a conductive filler material.

4. The switch of claim 3 wherein the conductive filler material comprises silver.

5. The switch of claim 1 wherein said moveable switch contact means comprises a conductive elastomeric plug seated on said hole within said frame means and electrically connected thereto and forming a deformable switch contact surface at an interior end thereof and having an exterior end, and said push button means comprises a non resilient pin member extending axially into said plug for part of its thickness from the exterior end thereof, whereby pressing an exterior end of the pin member deforms the elastomeric plug into electrical engagement with said switch contact member within said frame means thereby closing the switch, whereas, releasing the pin member enables the plug to resume its original undeformed shape, thereby opening the switch.

6. The switch of claim 5 wherein said plug is secured to said frame means by a conductive adhesive.

7. The switch of claim 5 wherein said plug has one or more annular rings about its periphery and said frame means defines one or more grooves corresponding to said rings within said hole.

8. The switch of claim 1 wherein the moveable switch contact means comprises a conductive pin member forming an exterior push button end, an interior switch contact end and a thinned middle portion, and said conductive elastomeric material comprises a sleeve engaging said frame means within said hole and engaging said conductive pin around its thinned middle portion.

9. The switch of claim 8 wherein a conductive metal sleeve is interposed between said frame means and said conductive elastomeric sleeve.

10. An improved push button electrical switch assembly for an electronic timepiece comprising in combination:

a. frame means defining a plurality of adjacently spaced apart openings;

b. a moveable switch contact means in each said opening and forming a switch contact surface at an interior end, said contact means having a pin extending from an exterior end;

c. a spring of conductive elastomeric material biasing each said moveable switch contact means and providing an electrical connection between said frame means and said moveable contact means;

d. plural switch contact members within said frame means, at least one said member adjacently spaced away from each said switch contact surface;

e. a push button bar connecting said pins at the exterior ends thereof, whereby when said bar is depressed at one location thereof, an adjacently located moveable switch contact means engages a corresponding contact member to provide a switch, and depressing said bar at another location provides another switch, and depressing said bar at a location between a pair of said adjacently spaced apart openings simultaneously provides a pair of switches.

* * * * *